US010101711B2

(12) United States Patent
Stackowski

(10) Patent No.: US 10,101,711 B2
(45) Date of Patent: Oct. 16, 2018

(54) PAST AND FUTURE TIME VISUALIZATION DEVICE

(71) Applicant: Barbara Carey Stackowski, Orinda, CA (US)

(72) Inventor: Barbara Carey Stackowski, Orinda, CA (US)

( * ) Notice: Subject to any disclaimer, the term of this patent is extended or adjusted under 35 U.S.C. 154(b) by 90 days.

(21) Appl. No.: 15/203,535

(22) Filed: Jul. 6, 2016

(65) Prior Publication Data

US 2018/0011450 A1 Jan. 11, 2018

(51) Int. Cl.

| | |
|---|---|
| ***G04G 9/00*** | (2006.01) |
| ***G04G 9/08*** | (2006.01) |
| ***G04G 11/00*** | (2006.01) |
| ***G04G 21/08*** | (2010.01) |
| ***G04G 13/02*** | (2006.01) |

(52) U.S. Cl.
CPC ..... *G04G 21/08* (2013.01); *G04G 9/00* (2013.01); *G04G 9/08* (2013.01); *G04G 11/00* (2013.01); *G04G 13/02* (2013.01)

(58) Field of Classification Search
CPC ..... G04F 1/005; G04F 10/00; G04G 9/00; G04G 9/08; G04G 9/0082; G04G 9/04; G04G 9/06; G04G 11/00; G04G 13/02; G04G 13/2108
See application file for complete search history.

(56) References Cited

U.S. PATENT DOCUMENTS 4,209,974 A * 7/1980 Noble ..... G04G 9/0094 368/232
4,407,587 A * 10/1983 Fujita ..... G04G 9/06 368/108
5,694,376 A * 12/1997 Sullivan ..... G04G 9/02 368/240
6,058,277 A * 5/2000 Streefkerk ..... G06F 3/04847 368/239
6,198,698 B1 * 3/2001 Graves ..... G04B 19/00 368/223
6,266,295 B1 * 7/2001 Parker ..... G06Q 10/109 368/28
6,388,952 B2 * 5/2002 Kim ..... G04G 9/0082 340/309.4
6,601,988 B2 * 8/2003 Molander ..... G04G 21/00 368/187
7,218,575 B2 * 5/2007 Rosevear ..... G04G 9/02 368/21
7,274,375 B1 * 9/2007 David ..... G06Q 10/06 345/619
7,590,553 B2 * 9/2009 Coates ..... G06Q 10/047 368/28
7,830,752 B2 * 11/2010 Rogers ..... G04F 1/005 368/240
7,907,476 B2 * 3/2011 Lee ..... G04G 5/04 345/173
8,687,467 B2 * 4/2014 Comeau ..... G04G 9/02 368/223
D787,524 S 5/2017 Jones
9,760,179 B2 9/2017 Petschnigg
(Continued)

*Primary Examiner* — Vit W Miska
(74) *Attorney, Agent, or Firm* — Haverstock & Owens LLP

(57) ABSTRACT

Past and future time visualization enables a user to visualize the amount of time that has passed or when a future time will be reached. By triggering past time visualization, a device displays an arced line from a previously selected time to the present time. By triggering future time visualization, a device displays an arced line from the present time to a selected future time. In some embodiments, when the future time is reached, an alarm is triggered.

31 Claims, 5 Drawing Sheets

(56) References Cited

U.S. PATENT DOCUMENTS

2001/0055244 A1* 12/2001 Kim ..... G04G 9/0082 368/73
2002/0126586 A1* 9/2002 Hamberg ..... G04F 1/005 368/113
2004/0225966 A1* 11/2004 Besharat ..... G06Q 10/109 715/705
2006/0133664 A1 6/2006 Hong et al.
2010/0162170 A1* 6/2010 Johns ..... G04G 9/06 715/834
2011/0004831 A1 1/2011 Steinberg
2011/0163970 A1 7/2011 Lemay
2012/0007995 A1 1/2012 Barrett
2012/0159318 A1 6/2012 Shaw
2013/0058198 A1* 3/2013 Tu ..... G04G 21/08 368/28
2013/0271351 A1* 10/2013 Lyons ..... G04G 17/083 345/1.1
2013/0271495 A1* 10/2013 Nguyen ..... G04G 17/083 345/649
2014/0331152 A1* 11/2014 Yanchar ..... G06Q 10/109 715/763
2015/0091809 A1 4/2015 Ibargoyen
2015/0100876 A1 4/2015 Neugebauer
2015/0172776 A1* 6/2015 Haziza ..... H04N 5/76 725/37
2016/0154383 A1* 6/2016 Kim ..... G04G 15/006 368/28
2016/0179353 A1* 6/2016 Iskander ..... G06F 3/04847 715/765
2017/0228121 A1* 8/2017 Wosk ..... G06F 3/0487

* cited by examiner

PAST AND FUTURE TIME VISUALIZATION DEVICE

FIELD OF THE INVENTION

The present invention relates to the field of watches, and more particularly, to smart watches.

BACKGROUND OF THE INVENTION

A clock/watch face or dial is the part of an analog clock/watch that displays the time through the use of a fixed-numbered dial or dials and moving hands. In its most basic form, recognized throughout the world, the periphery of the dial is numbered 1 through 12 indicating the hours in a 12-hour cycle, and a short hour hand makes two revolutions in a day. A longer minute hand makes one revolution every hour. The face may also include a second hand which makes one revolution per minute. The term is less commonly used for the time display on digital clocks and watches.

A digital time display usually displays time as a number, e.g., 12:08, but also can display time with digital moving hands. Most recently Apple® launched the Apple Watch which is an interactive smart watch that includes third party applications.

SUMMARY OF THE INVENTION

Past and future time visualization enables a user to visualize the amount of time that has passed or when a future time will be reached. By triggering past time visualization, a device displays an arced line from a previously selected time to the present time. By triggering future time visualization, a device displays an arced line from the present time to a selected future time. In some embodiments, when the future time is reached, an alarm is triggered.

In one aspect, the watch device of comprises a watch body, a touch screen coupled to the body, the touch screen configured for receiving user input, a memory configured for storing an application, the application configured for: displaying at least two modes of time simultaneously on the touch screen, wherein a first mode of the at least two modes of time is present time and a second mode of the at least two modes of time is past time or future time based on the present time and a processor configured for processing the application. Displaying the at least two modes includes displaying an arced line from the present time to a selected end time, wherein as time passes a portion of the arced line disappears and the arced line becomes shorter. When the present time equals the selected end time, an alarm is triggered, wherein the alarm is at least one of a sound, visual alarm or tactile alarm. Displaying the at least two modes includes displaying an arced line from a previously selected past time to the present time. Displaying the at least two modes includes displaying an arced line from an end of any of clock hands. The arced line is color coded to match a color of a clock hand. When the arced line makes a full revolution, a second arced line begins on the inside of the arced line. When the arced line makes a full revolution, a color of the arced line changes to a second color. The application is configured to detect a touch or swipe to configure the watch device in a future time mode or a past time mode, using the touchscreen. The application is configured to detect an amount of pressure of a touch to configure the watch device in a future time mode or a past time mode, using the touchscreen. The application is configured to detect a clockwise swiping motion to determine a future time mode for receiving input and a counter-clockwise swiping motion to determine a past time mode for receiving the input, using the touchscreen. The watch device further comprises a microphone for receiving a voice input to configure the watch device in a future time mode or a past time mode. The watch device further comprises a band coupled to the watch body.

In another aspect, a device comprises a body, a touch screen coupled to the body, the touch screen configured for receiving user input, a memory configured for storing an application, the application configured for: displaying at least two modes of time simultaneously on the touch screen, wherein a first mode of the at least two modes of time is present time and a second mode of the at least two modes of time is past time or future time based on the present time and a processor configured for processing the application. Displaying the at least two modes includes displaying an arced line from the present time to a selected end time, wherein as time passes a portion of the arced line disappears and the arced line becomes shorter. When the present time equals the selected end time, an alarm is triggered, wherein the alarm is at least one of a sound, visual alarm or tactile alarm. Displaying the at least two modes includes displaying an arced line from a previously selected past time to the present time. Displaying the at least two modes includes displaying an arced line from an end of any of clock hands. The arced line is color coded to match a color of a clock hand. When the arced line makes a full revolution, a second arced line begins on the inside of the arced line. When the arced line makes a full revolution, a color of the arced line changes to a second color. The application is configured to detect a touch or swipe to configure the device in a future time mode or a past time mode, using the touchscreen. The application is configured to detect an amount of pressure of a touch to configure the device in a future time mode or a past time mode, using the touchscreen. The application is configured to detect a clockwise swiping motion to determine a future time mode for receiving input and a counter-clockwise swiping motion to determine a past time mode for receiving the input, using the touchscreen. The device further comprises a microphone for receiving a voice input to configure the device in a future time mode or a past time mode.

In another aspect, a method programmed in a non-transitory memory of a device comprises receiving user input and displaying at least two modes of time simultaneously on the touch screen, wherein a first mode of the at least two modes of time is present time and a second mode of the at least two modes of time is past time or future time based on the present time and the user input. Displaying the at least two modes includes displaying an arced line from the present time to a selected end time, wherein as time passes a portion of the arced line disappears and the arced line becomes shorter. When the present time equals the selected end time, an alarm is triggered, wherein the alarm is at least one of a sound, visual alarm or tactile alarm. Displaying the at least two modes includes displaying an arced line from a previously selected past time to the present time. Displaying the at least two modes includes displaying an arced line from an end of any of clock hands. The arced line is color coded to match a color of a clock hand. When the arced line makes a full revolution, a second arced line begins on the inside of the arced line. When the arced line makes a full revolution, a color of the arced line changes to a second color. Receiving the user input includes detecting a touch or swipe to configure the device in a future time mode or a past time mode, using a touchscreen. Detecting the touch includes detecting an amount of pressure of the touch to configure the device in a future time mode or a past time mode, using the touchscreen. Receiving the user input includes detecting a clockwise swiping motion to determine a future time mode for receiving input and a counter-clockwise swiping motion to determine a past time mode for receiving the input, using a touchscreen. Receiving the user input includes receiving a voice input to configure the device in a future time mode or a past time mode.

DETAILED DESCRIPTION OF THE PREFERRED EMBODIMENT

The past and future time visualization device enables a user to visualize past and future time in real-time. The time visualization device is able to be implemented using hard buttons, touch screen, voice activation or any other input mechanism.

The visualization device generally relates to an analog display of time. Using the visualization device, three time periods are able to be visualized: past, present and future. The analog display of time is the present time. Past time is the display of time lapsed. A visual indicator appears at the first display of time (hour, minute or second hand), showing the growing concept of time in real-time according to the moving hands. Future time is the diminishing concept of time. A visual indicator related to a moving hand displays the length of time and as time elapses the visual display disappears showing the diminishing concept of time in real-time according to the moving hands.

Figure 1:
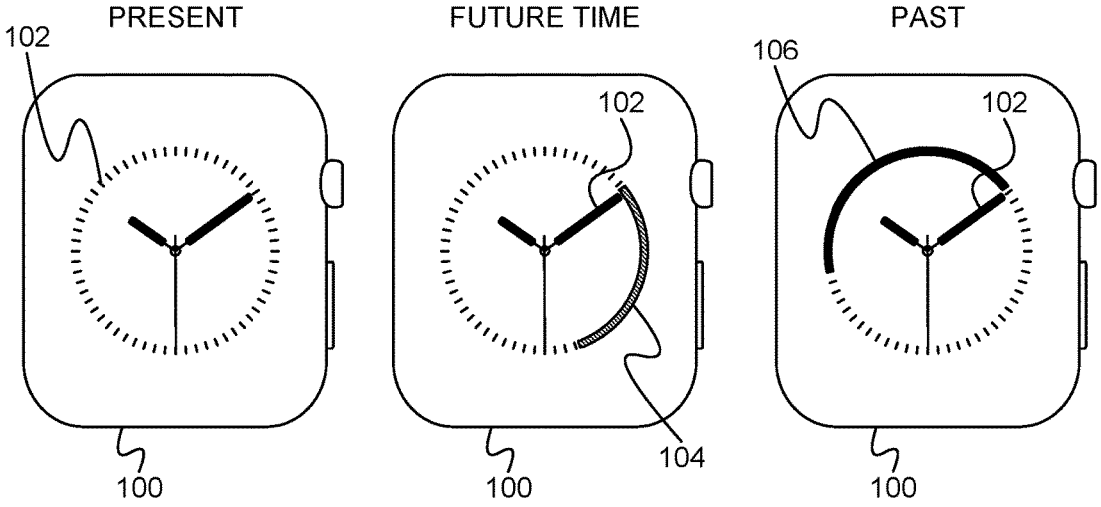
FIG. 1 illustrates present, future and past visualizations according to some embodiments.

FIG. 1 illustrates present, future and past visualizations according to some embodiments. The watch 100 showing the present time simply displays a standard analog clock 102 with a second hand, a minute hand and an hour hand (although in some embodiments, fewer hands may be included such as only displaying minute and hour hands).

For future time, the watch 100 still displays the analog clock 102, but also includes an arced line 104 around the outer path of the minute hand indicating future time beginning at the present time and ending at a designated end time (e.g., user inputs an end time via touch or voice). For example, at 10:09, a user touches the screen where 10:27 is, so the arced line 104 from 10:09 to 10:27 is drawn/displayed. As time moves forward, the arced line 104 disappears, is grayed out, changes color or is affected in some other manner. In some embodiments, when the clock reaches the end time, an alarm is indicated. The alarm is able to be a sound (e.g., ringtone), tactile (e.g., vibration, feeling of bumps), visual (e.g., flash screen) and/or any other alert. In some embodiments, there is no alarm. In some embodiments, the arced line 104 is displayed at the end of any or all hands (e.g., second, minute and/or hour). In some embodiments, the arced line 104 is color coded to match the hand (e.g., minute hand is red and arced line for minute hand is red, but second hand is blue and arced line for second hand is blue). In some embodiments, the arced line 104 is not from the end of the hand, but from another point on the hand (e.g., the middle of the hand). In some embodiments, another shape/configuration for tracking time is utilized. For example, instead of using an arced line, a zig zag line is used.

For past time, the watch 100 still displays the analog clock 102, but also includes an arced line 106 around the outer path of the minute hand indicating past time beginning at a designated start time and ending at the present time (e.g., users inputs start time via touch or voice an end time). For example, at 9:43, a user touched the screen, so the arced line 106 from 9:43 to 10:09 (the present time) is drawn/displayed. As time moves forward, the arced line 106 continues to grow. In some embodiments, the arced line 106 is displayed at the end of any or all hands (e.g., second, minute and/or hour). In some embodiments, the arced line 106 is color coded to match the hand (e.g., minute hand is red and arced line for minute hand is red, but second hand is blue and arced line for second hand is blue). In some embodiments, the arced line 106 is not from the end of the hand, but from another point on the hand (e.g., the middle of the hand). In some embodiments, when the arced line 106 makes a full revolution (e.g., after 1 hour for the minute hand), another line begins on the inside (toward the center of the watch) or the outside (away from the center of the watch) so that it is clear that more than 1 hour has passed. In some embodiments, when the arced line 106 makes a full revolution, the color of the line changes for the next revolution (either the same arced line changes color or a second arced line is a different color). For example, the arced line 106 is blue for the first revolution, and the arced line 106 stays blue except for the time that is beyond the first revolution, and that arced line is red. Furthering the example, if the user touches the watch at 10:00, then at 11:00, there will be a full blue line, but at 11:01, the arced line from 11:00 to 11:01 is red, while the rest of the line is still blue, and so on, for example, when the clock is at 11:30, half of the arced line is blue, and the other half is red. Other indicators that more than one hour has passed are able to be used (e.g., a number is displayed in a corner or elsewhere indicating the number of hours passed). In some embodiments, another shape/configuration for tracking time is utilized. For example, instead of using an arced line, a zig zag line is used.

Figure 2:
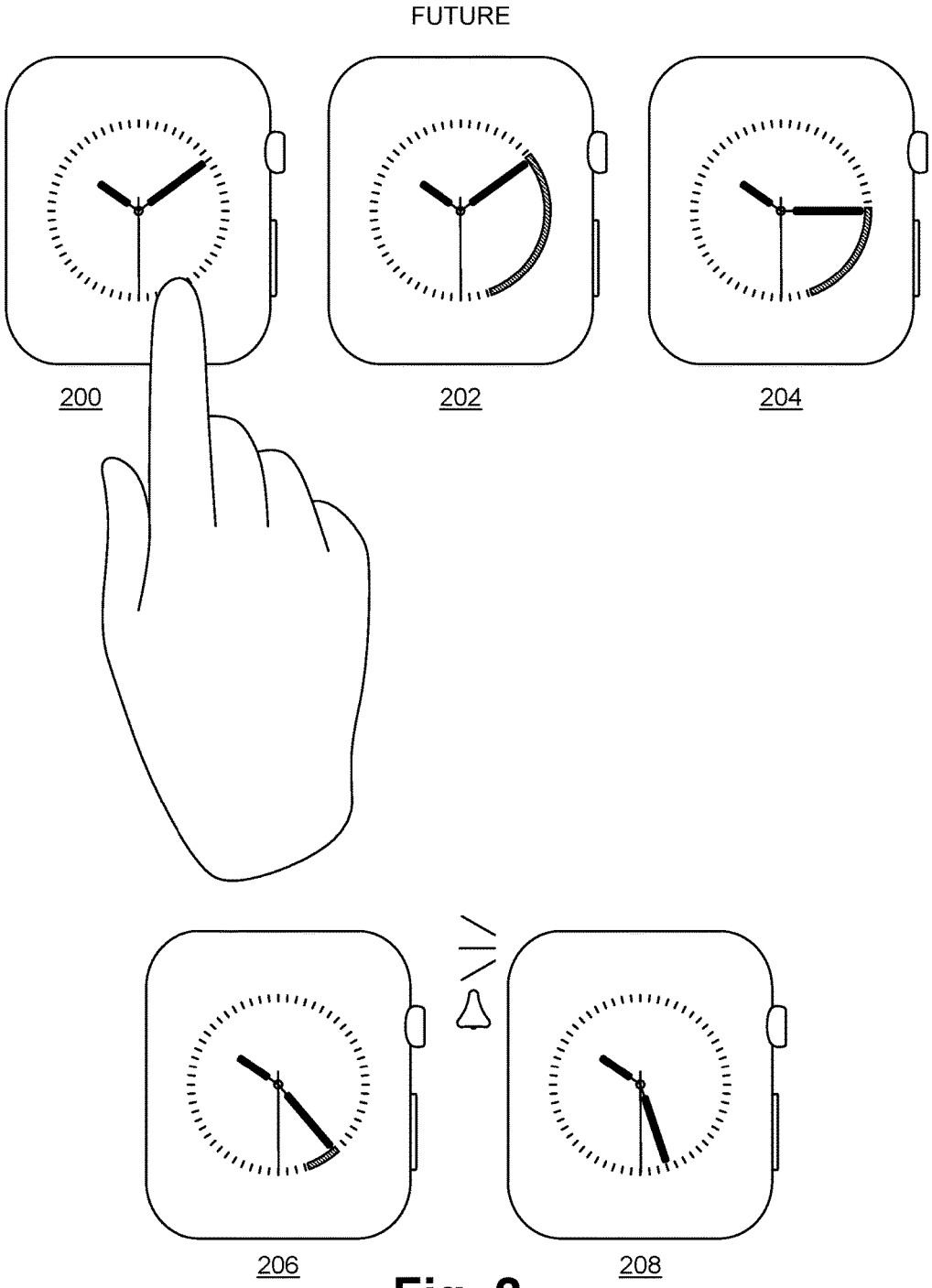
FIG. 2 illustrates the process of setting a future visual indicator according to some embodiments.

FIG. 2 illustrates the process of setting a future visual indicator according to some embodiments. In the step 200, a user provides input of a future end time. The input is able to be provided in any manner such as a user touching a location on the screen corresponding to a time on the clock where to stop, speaking (e.g., "Siri, future end time 10:27"), and/or any other input. In some embodiments, when the user touches the screen, a zoomed in version of the clock appears, specifically, the section of the clock where the user touched, or a pop up appears with a digital timer to enter in a specific time. In some embodiments, the input includes the user touching one of the clock hands and drawing the time. For example, the user touches the minute hand and makes a clockwise swiping motion to 10 minutes ahead of the present time. In some embodiments, swiping is able to be a vertical swipe, horizontal swipe, diagonal swipe and/or any other swipe. In some embodiments, a clockwise swipe is detected by incrementally detecting horizontal and vertical swipes such that it is determined if the swipe is clockwise or counter-clockwise. For example, a clockwise swipe is detected by determining a horizontal swipe from left to right and a vertical swipe down followed by a horizontal swipe from right to left; conversely, a counter-clockwise swipe is detected by determining a horizontal swipe from left to right and a vertical swipe down followed by a horizontal swipe from left to right. The input is able to be a touch/press, long touch, or double touch (similar to a double-click). For example, the device is able to detect the amount of pressure and/or duration of the touch. In some embodiments, multiple inputs are used (e.g., to set a future time of more than one hour). For example, a user first taps the hour hand and then selects the hour by pressing the hour number or by pressing in the hour hand's quadrant (e.g., between 12 and 1 is 12's quadrant, between 1 and 2 is 1's quadrant and so on until between 11 and 12 which is 11's quadrant), then the user taps the minute hand and then selects the minute by pressing the minute number or minute representation. In some implementations, the user draws multiple circles or revolutions to represent multiple hours. For example, the user draws two circles and a quarter circle to set the end time 2 hours and 15 minutes from the present time. In the step 202, the arced line or other indicator is displayed from the present time to the end time. In the step 204, as time passes, the minute hand moves closer to the end time, and the arced line shrinks toward the end time. In the step 206, time has passed farther, and the arced line has shrunk more toward the end time. In the step 208, the time has reached the end time, and an alarm is triggered. In some embodiments, fewer or additional steps are implemented.

Figure 3:
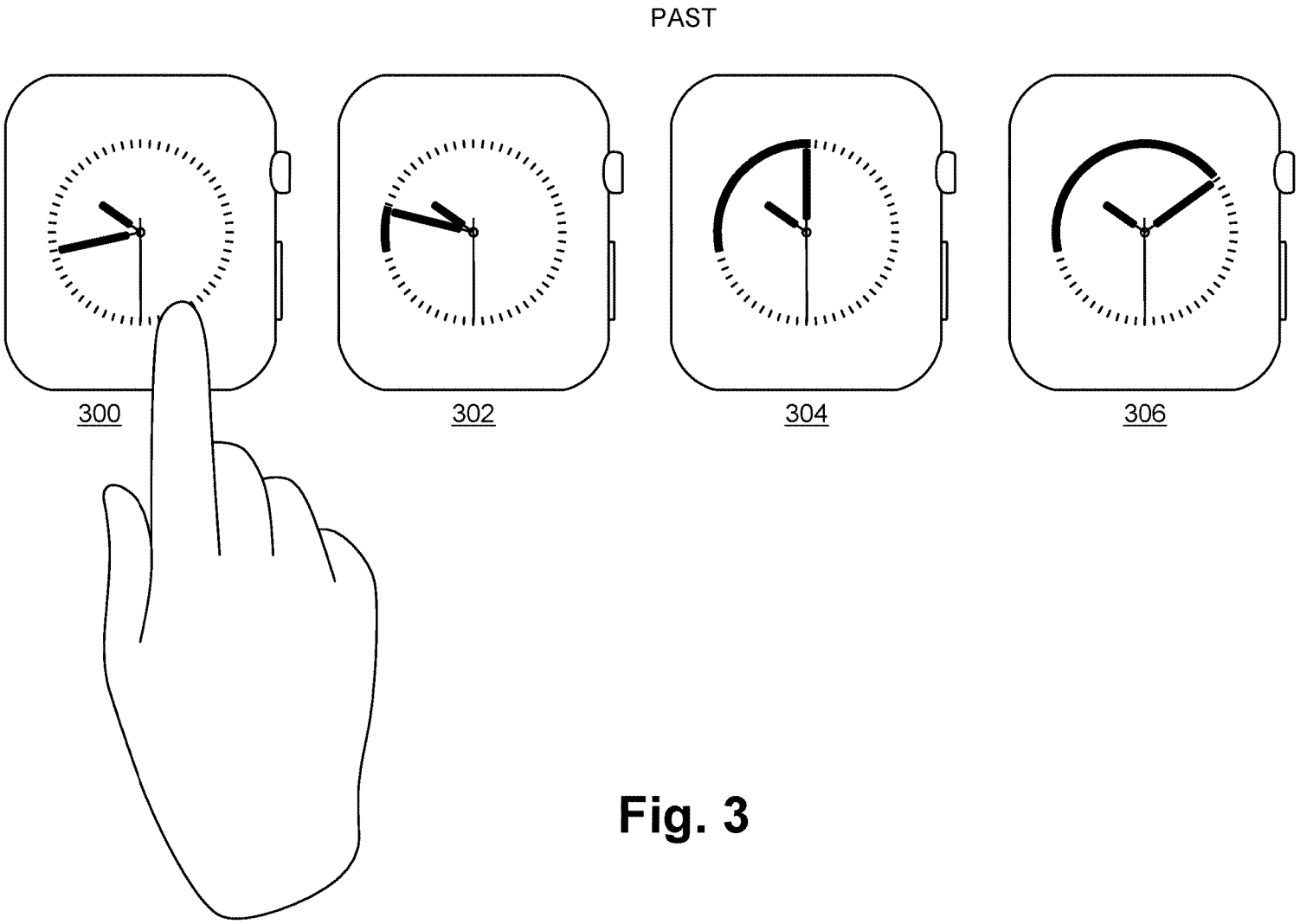
FIG. 3 illustrates the process of setting a past visual indicator according to some embodiments.

FIG. 3 illustrates the process of setting a past visual indicator according to some embodiments. In the step 300, a user provides input of a start time. The input is able to be provided in any manner such as a user touching the screen, speaking (e.g., "Siri, start timer"), and/or any other input. For example, the user touches the minute hand and makes a counter-clockwise swiping motion. In some embodiments, swiping is able to be a vertical swipe, horizontal swipe, diagonal swipe and/or any other swipe. The input is able to be a touch/press, long touch, or double touch (similar to a double-click). For example, the device is able to detect the amount of pressure and/or duration of the touch. In the step 302, as time passes, the arced line or other indicator is displayed from the start time to the present time. In the step 304, as more time passes, the minute hand moves farther from the start time, and the arced line gets longer. In the step 306, time has even passed farther, and the arced line has become even longer. In some embodiments, fewer or additional steps are implemented.

In some embodiments, the input is used to distinguish between a future visualization and a past visualization. For example, a user swipes clockwise to set a future visualization and swipes counter-clockwise to set a past visualization. In another example, the user swipes left for future visualization and right for past visualization, or vertically for future visualization and horizontally for past visualization. In another example, the user touches anywhere on the clock but the current time (e.g., anywhere but the minute hand) for future visualization, and the user touches the minute hand for past visualization. In yet another example, the user does a quick touch or a light touch for future visualization, and the user uses a double-touch, long touch or hard pressure touch for past visualization. In another example, the user toggles a future or past switch (soft or hard key) before touching the clock. Any implementation is able to be used to distinguish triggering future and past visualization.

Figure 4:
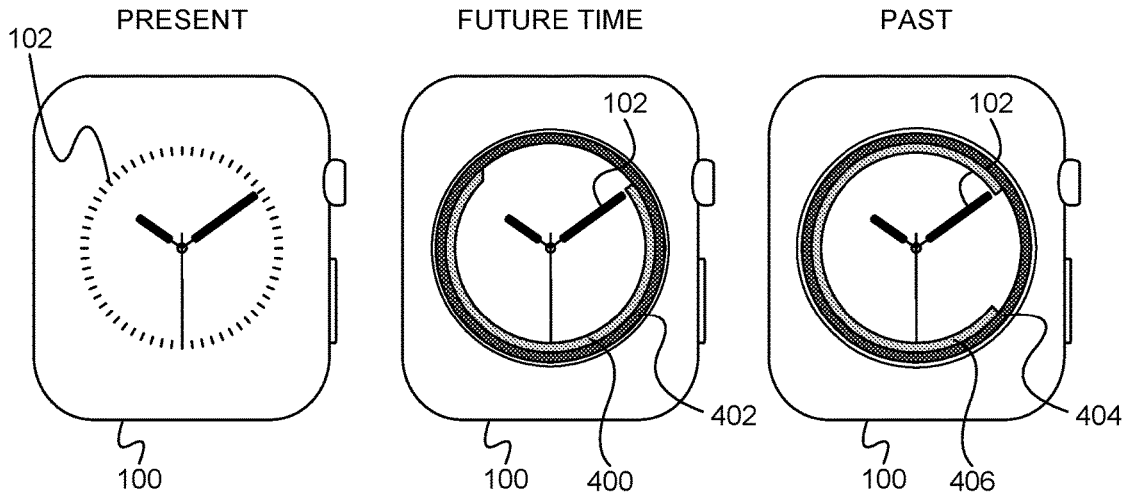
FIG. 4 illustrates present, future and past visualizations according to some embodiments.

FIG. 4 illustrates present, future and past visualizations according to some embodiments. The devices shown in FIG. 4 are similar to those in FIG. 1.

The watch 100 showing the present time simply displays a standard analog clock 102 with a second hand, a minute hand and an hour hand (although in some embodiments, fewer hands may be included such as only displaying minute and hour hands).

For future time, the watch 100 displays the analog clock 102, but also includes a first arced line 400 around the outer path of the minute hand indicating future time beginning at the present time and ending at a designated end time. As described herein, when the future time is more than 1 hour ahead (more than 1 revolution), a second arced line 402 is displayed. In some embodiments, additional arced lines are displayed, where each full arced line represents 1 hour. In some embodiments, the arced lines are concentric circles beginning with the outer ring and going inward or vice versa. In some embodiments, the arced lines have distinguishing features (e.g., first arced line is blue and second arced line is red) to ease readability.

For past time, the watch 100 displays the analog clock 102, but also includes a first arced line 404 around the outer path of the minute hand indicating past beginning at a selected start time and ending at the present time. As described herein, when the past time is more than 1 hour (more than 1 revolution), a second arced line 406 is displayed. In some embodiments, additional arced lines are displayed, where each full arced line represents 1 hour. In some embodiments, the arced lines are concentric circles beginning with the outer ring and going inward or vice versa. In some embodiments, the arced lines have distinguishing features (e.g., first arced line is blue and second arced line is red) to ease readability.

In some embodiments, the clock is able to indicate a combination of future and past time visualization. For example, the user wants to set a future visualization and a past visualization. The user is able to select each by providing different inputs as described herein (e.g., clockwise swipe for future time and counter-clockwise swipe for past time, or quick touch versus long touch). The future and past time visualizations are able to be distinguished using any feature (e.g., color). In an example, the user makes a quick touch for past time tracking which starts displaying a red arced line from the present time, and the user makes a long touch 25 minutes from the current time for future time tracking which displays a blue arced line from the present time to the time 25 minutes ahead, where the blue arced line is closer to the center of the watch than the red arced line.

Figure 5:
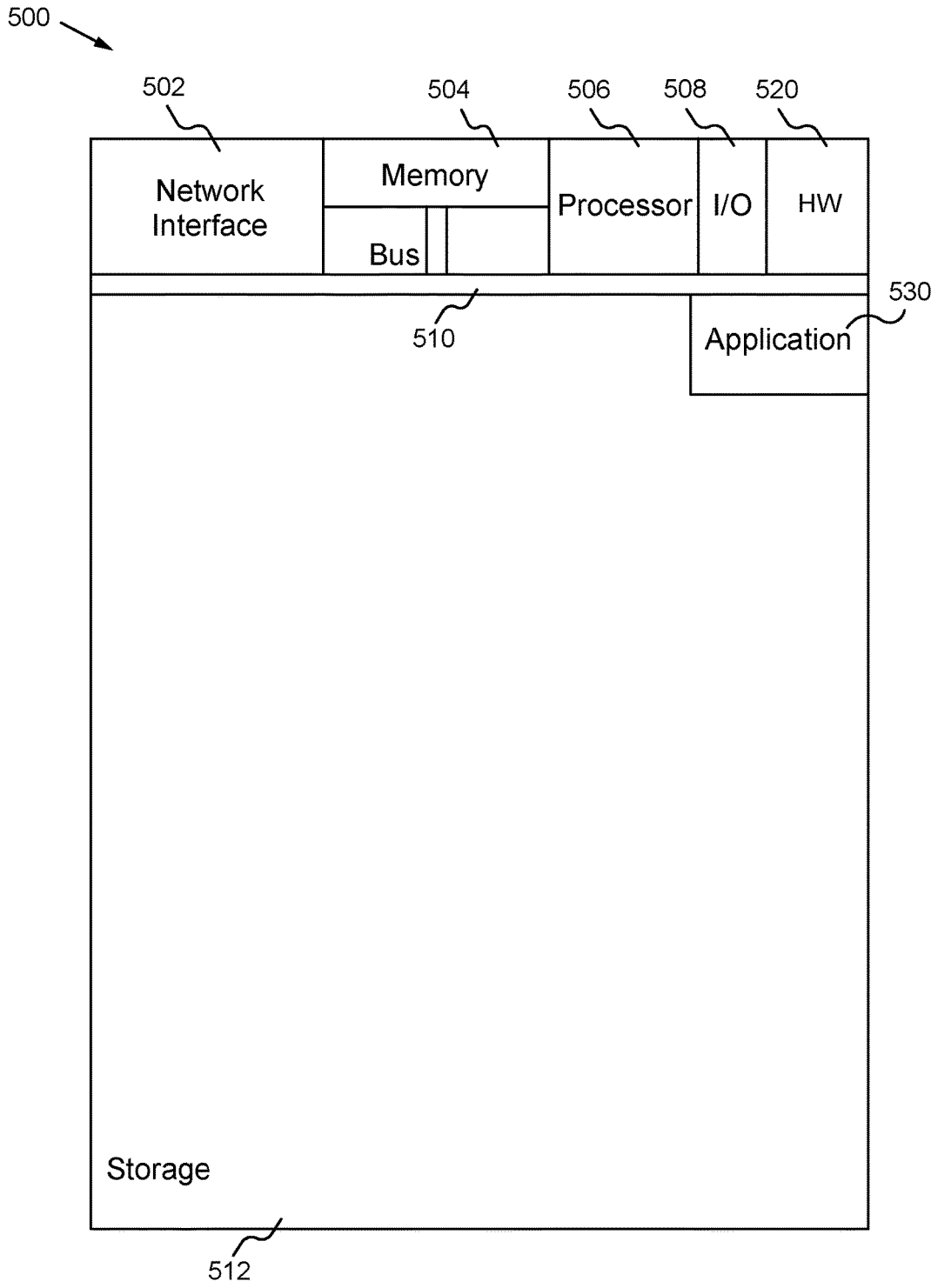
FIG. 5 illustrates a block diagram of an exemplary computing device configured to implement the time visualization method according to some embodiments.

FIG. 5 illustrates a block diagram of an exemplary computing device configured to implement the time visualization method according to some embodiments. The computing device 500 is able to be used to acquire, store, compute, process, communicate and/or display information such as text, images, videos and audio. In general, a hardware structure suitable for implementing the computing device 500 includes a network interface 502, a memory 504, a processor 506, I/O device(s) 508, a bus 510 and a storage device 512. The choice of processor is not critical as long as a suitable processor with sufficient speed is chosen. The memory 504 is able to be any conventional computer memory known in the art. The storage device 512 is able to include a hard drive, CDROM, CDRW, DVD, DVDRW, High Definition disc/drive, ultra-HD drive, flash memory card or any other storage device. The computing device 500 is able to include one or more network interfaces 502. An example of a network interface includes a network card connected to an Ethernet or other type of LAN. The I/O device(s) 508 are able to include one or more of the following: keyboard, mouse, monitor, screen, printer, modem, touchscreen, button interface and other devices. Time visualization application(s) 530 used to implement the time visualization method are likely to be stored in the storage device 512 and memory 504 and processed as applications are typically processed. More or fewer components shown in FIG. 5 are able to be included in the computing device 500. In some embodiments, time visualization hardware 520 is included. Although the computing device 500 in FIG. 5 includes applications 530 and hardware 520 for the time visualization method, the time visualization method is able to be implemented on a computing device in hardware, firmware, software or any combination thereof. For example, in some embodiments, the time visualization method 530 are programmed in a memory and executed using a processor. In another example, in some embodiments, the time visualization hardware 520 is programmed hardware logic including gates specifically designed to implement the time visualization method.

In some embodiments, the time visualization application(s) 530 include several applications and/or modules. In some embodiments, modules include one or more sub-modules as well. In some embodiments, fewer or additional modules are able to be included.

Examples of suitable computing devices include smart jewelry (e.g., smartwatch), a personal computer, a laptop computer, a computer workstation, a server, a mainframe computer, a handheld computer, a personal digital assistant, a cellular/mobile telephone, a smart appliance, a game console, a digital camera, a digital camcorder, a camera phone, a smart phone, a portable music player, a tablet computer, a mobile device, a video player, a video disc writer/player (e.g., DVD writer/player, high definition disc writer/player, ultra high definition disc writer/player), a television, a home entertainment system, a toy (e.g., a stuffed animal) or any other suitable computing device.

For example, a smartwatch includes a band or other mechanism to secure a smartwatch body to a user's wrist. The smartwatch body includes a touchscreen display, sensors, microphone and speaker as well as memory and a processor for processing a mobile operating system and applications, along with any other computing components. The smartwatch body may also include hard (physical) buttons or other structures. The applications, in conjunction with the touchscreen and/or microphone, receive input from a user such as touches, swipes, voice input. The touchscreen of the smartwatch is able to determine location of the touch, amount of pressure of the touch as well as other aspects of the touch or swipe. Based on the input to the smartwatch, the time visualization method is implemented as described herein.

To utilize the time visualization method, a user provides input to the device which triggers future time visualization, past time visualization or both. Once triggered, the device displays the time in a manner so that a user is able to visualize the amount of time that has passed or when a future time will be reached.

In operation, the time visualization method provides a visualization of future time or tracks past time.

Although the time visualization method has been described as implemented on a watch, the time visualization method is able to be implemented on any device such as a smart phone, a computer, a tablet, or a laptop.

The present invention has been described in terms of specific embodiments incorporating details to facilitate the understanding of principles of construction and operation of the invention. Such reference herein to specific embodiments and details thereof is not intended to limit the scope of the claims appended hereto. It will be readily apparent to one skilled in the art that other various modifications may be made in the embodiment chosen for illustration without departing from the spirit and scope of the invention as defined by the claims.

What is claimed is:

1. A watch device comprising:

a. a watch body;

b. a touch screen coupled to the body, the touch screen configured for receiving user input;

c. a memory configured for storing an application, the application configured for: displaying at least two modes of time simultaneously on the touch screen, wherein a first mode of the at least two modes of time is present time and a second mode of the at least two modes of time is past time or future time based on the present time, wherein displaying the at least two modes includes displaying an arced line from an end of any of clock hands, wherein when the arced line makes a full revolution, a color of the arced line changes to a second color; and d. a processor configured for processing the application.

2. The watch device of claim 1 wherein displaying the at least two modes includes displaying an arced line from the present time to a selected end time, wherein as time passes a portion of the arced line disappears and the arced line becomes shorter.

3. The watch device of claim 2 wherein when the present time equals the selected end time, an alarm is triggered, wherein the alarm is at least one of a sound, visual alarm or tactile alarm.

4. The watch device of claim 1 wherein displaying the at least two modes includes displaying an arced line from a previously selected past time to the present time.

5. The watch device of claim 1 wherein the arced line is color coded to match a color of a clock hand.

6. The watch device of claim 1 wherein when the arced line makes a full revolution, a second arced line begins on the inside of the arced line.

7. The watch device of claim 1 wherein the application is configured to detect a touch or swipe to configure the watch device in a future time mode or a past time mode, using the touchscreen.

8. The watch device of claim 7 wherein the application is configured to detect an amount of pressure of a touch to configure the watch device in a future time mode or a past time mode, using the touchscreen.

9. The watch device of claim 1 wherein the application is configured to detect a clockwise swiping motion to determine a future time mode for receiving input and a counterclockwise swiping motion to determine a past time mode for receiving the input, using the touchscreen.

10. The watch device of claim 1 further comprising a microphone for receiving a voice input to configure the watch device in a future time mode or a past time mode.

11. The watch device of claim 1 further comprising a watch band coupled to the watch body.

12. A device comprising:

a. a body;

b. a touch screen coupled to the body, the touch screen configured for receiving user input;

c. a memory configured for storing an application, the application configured for: displaying at least two modes of time simultaneously on the touch screen, wherein a first mode of the at least two modes of time is present time and a second mode of the at least two modes of time is past time or future time based on the present time, wherein displaying the at least two modes includes displaying an arced line from an end of any of clock hands, wherein when the arced line makes a full revolution, a color of the arced line changes to a second color; and d. a processor configured for processing the application.

13. The device of claim 12 wherein displaying the at least two modes includes displaying an arced line from the present time to a selected end time, wherein as time passes a portion of the arced line disappears and the arced line becomes shorter.

14. The device of claim 13 wherein when the present time equals the selected end time, an alarm is triggered, wherein the alarm is at least one of a sound, visual alarm or tactile alarm.

15. The device of claim 12 wherein displaying the at least two modes includes displaying an arced line from a previously selected past time to the present time.

16. The device of claim 12 wherein the arced line is color coded to match a color of a clock hand.

17. The device of claim 16 wherein when the arced line makes a full revolution, a second arced line begins on the inside of the arced line.

18. The device of claim 12 wherein the application is configured to detect a touch or swipe to configure the device in a future time mode or a past time mode, using the touchscreen.

19. The device of claim 18 wherein the application is configured to detect an amount of pressure of a touch to configure the device in a future time mode or a past time mode, using the touchscreen.

20. The device of claim 12 wherein the application is configured to detect a clockwise swiping motion to determine a future time mode for receiving input and a counter-clockwise swiping motion to determine a past time mode for receiving the input, using the touchscreen.

21. The device of claim 12 further comprising a microphone for receiving a voice input to configure the device in a future time mode or a past time mode.

22. A method programmed in a non-transitory memory of a device comprising:

a. receiving user input; and b. displaying at least two modes of time simultaneously on the touch screen, wherein a first mode of the at least two modes of time is present time and a second mode of the at least two modes of time is past time or future time based on the present time and the user input, wherein displaying the at least two modes includes displaying an arced line from an end of any of clock hands, wherein when the arced line makes a full revolution, a color of the arced line changes to a second color.

23. The method of claim 22 wherein displaying the at least two modes includes displaying an arced line from the present time to a selected end time, wherein as time passes a portion of the arced line disappears and the arced line becomes shorter.

24. The method of claim 23 wherein when the present time equals the selected end time, an alarm is triggered, wherein the alarm is at least one of a sound, visual alarm or tactile alarm.

25. The method of claim 22 wherein displaying the at least two modes includes displaying an arced line from a previously selected past time to the present time.

26. The method of claim 22 wherein the arced line is color coded to match a color of a clock hand.

27. The method of claim 26 wherein when the arced line makes a full revolution, a second arced line begins on the inside of the arced line.

28. The method of claim 22 wherein receiving the user input includes detecting a touch or swipe to configure the device in a future time mode or a past time mode, using a touchscreen.

29. The method of claim 28 wherein detecting the touch includes detecting an amount of pressure of the touch to configure the device in a future time mode or a past time mode, using the touchscreen.

30. The method of claim 22 wherein receiving the user input includes detecting a clockwise swiping motion to determine a future time mode for receiving input and a counter-clockwise swiping motion to determine a past time mode for receiving the input, using a touchscreen.

31. The method of claim 22 wherein receiving the user input includes receiving a voice input to configure the device in a future time mode or a past time mode.

* * * * *